US011463821B2

(12) United States Patent
Davis et al.

(10) Patent No.: US 11,463,821 B2
(45) Date of Patent: Oct. 4, 2022

(54) AUDIO ACCESSORY

(71) Applicant: Nuheara IP Pty Ltd, Northbridge, WA (US)

(72) Inventors: Alan Davis, Riverton (AU); Gregory Paul Breen, Nedlands (AU); Clint Mathurine, Bayswater (AU); Peter Mather Combes, Floreat (AU); Andrew Victor Cammell, Beeliar (AU)

(73) Assignee: NUHEARA IP PTY LTD, Northbridge (AU)

( * ) Notice: Subject to any disclaimer, the term of this patent is extended or adjusted under 35 U.S.C. 154(b) by 0 days.

(21) Appl. No.: 17/176,339

(22) Filed: Feb. 16, 2021

(65) Prior Publication Data

US 2021/0168519 A1 Jun. 3, 2021

Related U.S. Application Data

(63) Continuation of application No. 16/732,805, filed on Jan. 2, 2020, now abandoned.

(30) Foreign Application Priority Data

Jan. 4, 2019 (AU) ..... 2019900027

(51) Int. Cl.
*H04R 25/00* (2006.01)

(52) U.S. Cl.
CPC ..... *H04R 25/43* (2013.01); *H04R 25/554* (2013.01); *H04R 25/558* (2013.01); *H04R 2225/55* (2013.01)

(58) Field of Classification Search
CPC .... H04R 25/43; H04R 25/554; H04R 25/558; H04R 2225/55; H04R 2227/005;
(Continued)

(56) References Cited

U.S. PATENT DOCUMENTS 9,525,951 B2 12/2016 Park
2004/0185773 A1 9/2004 Gerber et al.
(Continued)

FOREIGN PATENT DOCUMENTS

WO WO-2007085267 A2 * 8/2007 ..... H03G 1/02

OTHER PUBLICATIONS

International-Type Search Report dated Jun. 21, 2019 (20 pages) out of priority Australian Patent Application No. 2019900027 filed Jan. 4, 2019.

*Primary Examiner* — Angelica M McKinney
(74) *Attorney, Agent, or Firm* — Crowell & Moring LLP; John C. Freeman

(57) ABSTRACT

An audio transmitter including an audio input interface receiving first audio signals indicative of input audio from an audio source, a wireless transmitter wirelessly streaming second audio signals indicative of the input audio to a first audio reproducing device, and an audio output interface connectable to a second audio reproducing device, the audio transmitter arranged to supply third audio signals indicative of the input audio to the audio output interface. The audio transmitter facilitates connection to the audio transmitter to control wireless streaming of the second audio signals. A characteristic of sound of the wirelessly streamed second audio signals is controllable independently of a characteristic of sound of the third audio signals. An initial connection is established between the audio transmitter and a computing device in response to detection that the location of the computing device relative to the audio transmitter is less than a defined threshold.

28 Claims, 10 Drawing Sheets

(58) Field of Classification Search
CPC ..... H04R 1/1041; H04R 1/1016; H04R 2420/01; H04R 2420/07; H04R 3/12; H04R 5/04; H04R 5/033; H04S 7/302; H04S 7/303; G06F 3/165; H03G 3/3005; H04H 20/33; H04L 12/2807; H04M 2250/02; H04W 4/80; H04B 1/202; H04B 2001/3866
See application file for complete search history.

(56) References Cited

U.S. PATENT DOCUMENTS

| | | | | |
|---|---|---|---|---|
| 2004/0247139 | A1* | 12/2004 | Wang ..... | H04B 1/202 381/74 |
| 2005/0086058 | A1 | 4/2005 | Lemelson et al. | |
| 2010/0057471 | A1 | 3/2010 | Kong et al. | |
| 2011/0216928 | A1 | 9/2011 | Eisenberg et al. | |
| 2015/0365771 | A1 | 12/2015 | Tehrani | |
| 2016/0249356 | A1* | 8/2016 | Pope ..... | H04W 4/80 |
| 2017/0289683 | A1 | 10/2017 | Eichfeld et al. | |

* cited by examiner

AUDIO ACCESSORY

This application is a continuation of U.S. patent application Ser. No. 16/732,805, filed on Jan. 2, 2020, which claims priority under 35 U.S.C. § 119(a) to Australian Patent Application No. 2019900027, filed on Jan. 4, 2019, the entire contents of each of which are incorporated herein by reference.

FIELD OF THE INVENTION

The present invention relates to an audio accessory for use with a personal audio reproducing device such as audio reproducing earbuds, and to an audio reproducing system that includes the audio accessory.

BACKGROUND OF THE INVENTION

It is known that in order for some people with hearing difficulties to clearly hear sounds, in particular speech, from a television (TV), the person will often increase the volume of the sound from the TV until the sounds can be clearly heard.

However, while increasing the TV sound can be effective for such a person, a potential consequence is that other people that are also watching the TV at the same time may consider the TV sound to be uncomfortably loud.

SUMMARY OF THE INVENTION

In accordance with a first aspect of the present invention, there is provided an audio transmitter comprising:

an audio input interface arranged to receive first audio signals indicative of input audio from an audio source;

a wireless transmitter arranged to wirelessly stream second audio signals indicative of the input audio to a personal first audio reproducing device wearable by a user; and an audio output interface connectable to a second audio reproducing device, the audio transmitter arranged to supply third audio signals indicative of the input audio to the audio output interface;

the audio transmitter arranged to facilitate connection by a computing device to the audio transmitter to facilitate control of wireless streaming of the second audio signals using the computing device;

wherein at least one characteristic of sound associated with the wirelessly streamed second audio signals is controllable independently of at least one characteristic of sound associated with the third audio signals; and wherein an initial connection is established between the audio transmitter and the computing device in response to detection that the location of the computing device relative to the audio transmitter is less than a defined threshold.

In an embodiment, the at least one characteristic of sound includes volume, equalization, frequency response, phase, frequency dependent dynamic range, dynamic range compression, noise and/or delay.

In an embodiment, the audio transmitter is arranged to facilitate connection by a computing device to the audio transmitter to facilitate activation of wireless streaming of the second audio signals using the computing device and/or control of at least one characteristic of sound associated with the wirelessly streamed second audio signals.

In an embodiment, the audio input interface is a wired audio input interface that may be an analogue signal interface or a digital signal interface.

In an embodiment, the audio output interface is a wired audio output interface that may be an analogue signal interface or a digital signal interface.

In an embodiment, the audio transmitter is arranged to wirelessly stream the second audio signals using a Bluetooth connection that may use Bluetooth Classic protocols, for example that include Advanced Audio Distribution Profile (A2DP).

In an embodiment, the audio transmitter may include a digital signal processor arranged to encode the second audio signals, for example using a low latency protocol including aptX Low Latency (aptXLL).

In an embodiment, the audio transmitter is arranged to communicate with the computing device using a Bluetooth connection that may use a Bluetooth Low Energy (BLE) protocol.

In an embodiment, the audio transmitter comprises an audio signal conditioner arranged to modify the timing of the third audio signals relative to the second audio signals so that audio from the personal first audio reproducing device and a second audio reproducing device connected to the audio output interface are substantially in synchronization with each other at a user.

In an embodiment, the audio transmitter is arranged to emit an identification advertisement including unique identification information associated with the audio transmitter, the unique identification information usable by the computing device to identify the audio transmitter.

In an embodiment, the audio transmitter comprises a status indicator arranged to visually indicate the connection status, streaming status and/or power status of the audio transmitter.

In accordance with a second aspect of the present invention, there is provided an audio reproducing system comprising:

an audio transmitter according to the first aspect of the invention; and a computing device wirelessly connectable to the audio transmitter and usable to control wireless streaming of the second audio signals and to control the at least one characteristic of sound associated with the wirelessly streamed second audio signals;

wherein the system is arranged to determine whether the computing device has moved to a location within a defined threshold from the audio transmitter, and to create and store connection information associated with a wireless connection between the computing device and the audio transmitter when the location of the computing device is less than the defined threshold.

In an embodiment, the computing device is arranged to determine a signal strength value indicative of a signal strength of the identification advertisement received at the computing device, and to determine whether the computing device has moved to a location within the defined threshold from the audio transmitter by comparing the signal strength value with a reference threshold value. The signal strength value may comprise a received signal strength indication (RSSI) value.

In an embodiment, the computing device may be arranged to debounce the signal strength value, for example by tracking a differential of the signal strength value as the computing device moves closer to the audio transmitter.

In an embodiment, the computing device is arranged to receive the identification advertisement and to display audio transmitter indicia indicative of the audio transmitter, the displayed audio transmitter indicia being selectable by a user to instigate wireless streaming of the second audio signals to a personal first sound reproducing device. The computing device may be arranged to receive identification advertisements associated with multiple different audio transmitters, and to display audio transmitter indicia indicative of the audio transmitters for selection by a user.

In an embodiment, the computing device is arranged to wirelessly connect to a personal first sound reproducing device, and the system is arranged to instigate streaming of the second audio signals to the personal first sound reproducing device connected to the computing device when an audio transmitter is selected by a user using the computing device.

In an embodiment, when an audio transmitter is selected by a user using the computing device, the computing device is arranged to:

communicate personal audio reproducing device identification data indicative of the personal first audio reproducing device connected to the computing device to the audio transmitter, and communicate audio transmitter identification data indicative of the selected audio transmitter to the personal first audio reproducing device connected to the computing device;

wherein the communicated personal audio reproducing device identification data and audio transmitter identification data are used to initiate a streaming connection between the audio transmitter and the personal first audio reproducing device.

In an embodiment, the computing device is arranged to communicate with the personal first audio reproducing device using a Bluetooth connection that may use a Bluetooth Classic protocol and a Bluetooth Low Energy (BLE) protocol.

In an embodiment, the system is arranged such that the computing device connects to the audio transmitter only when control signals are communicated between the computing device and the audio transmitter.

In an embodiment, the computing device comprises a smartphone.

In an embodiment, the system includes at least one personal first audio reproducing device that may include a pair of earbuds or wireless in ear or over ear headphones.

In an embodiment, the computing device is arranged to send a volume control signal to a personal first audio reproducing device in response to volume control input from a user, the personal first audio reproducing device using the volume control signal to modify the volume of sound associated with the wirelessly streamed second audio signals.

BRIEF DESCRIPTION OF THE DRAWINGS

The present invention will now be described, by way of example only, with reference to the accompanying drawings, in which.

DESCRIPTION OF AN EMBODIMENT OF THE INVENTION

Figure 1:
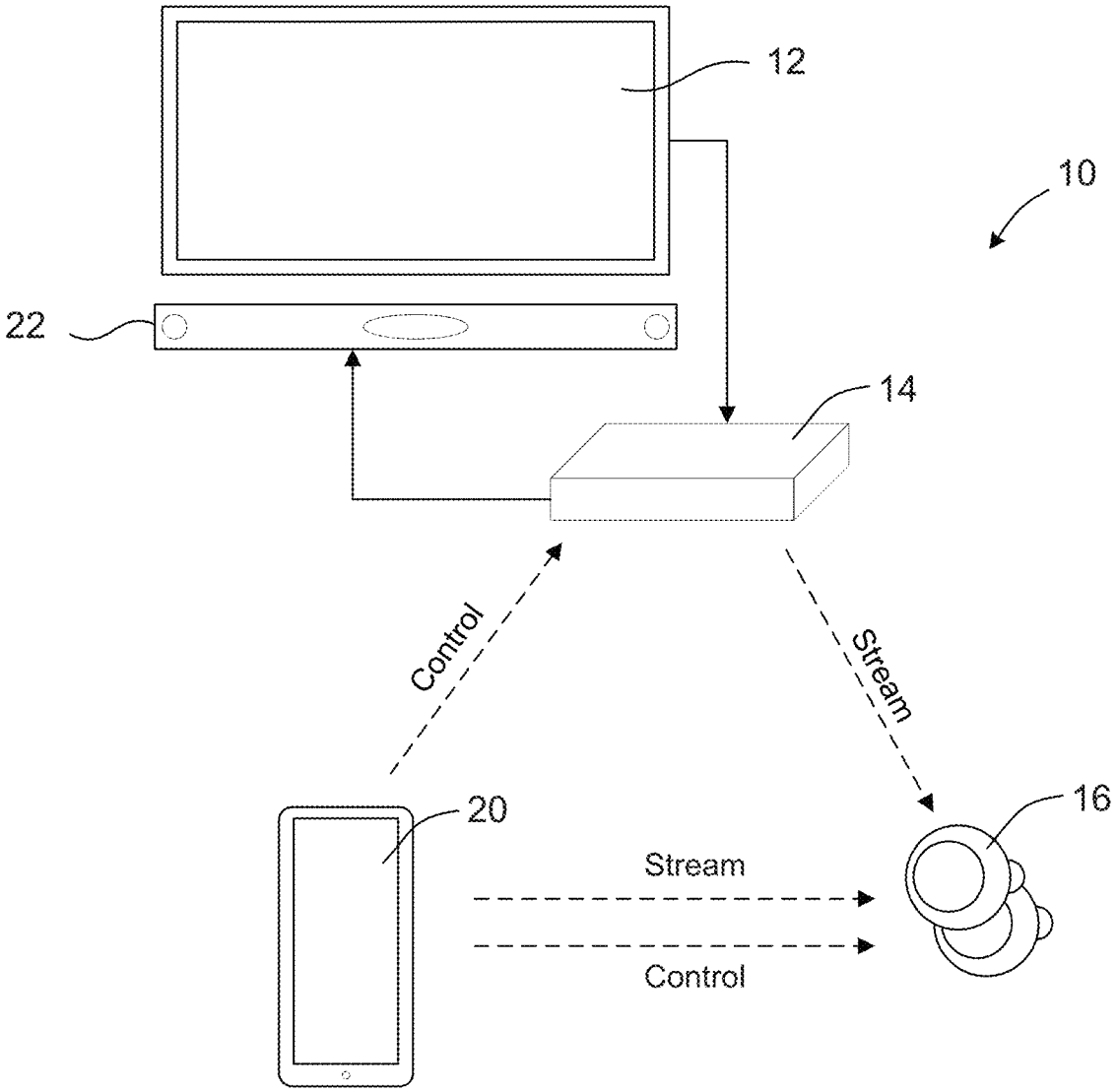
FIG. 1 is a diagrammatic representation of an audio reproducing system in accordance with an embodiment of the present invention.

Referring to FIG. 1 of the drawings, there is shown a representation of an embodiment of an audio reproducing system 10.

During use, the system 10 is arranged to receive first audio signals representative of audio from an audio source, in this example a television 12, at an audio transmitter 14 and to wirelessly transmit second audio signals representative of the audio from the audio transmitter 14 to a wireless personal audio reproducing device 16 under control of a computing device 20.

In this example, the personal audio reproducing device 16 is a pair of earbuds for use in left and right ears of a user, although it will be understood that any suitable wireless personal audio reproducing device is envisaged, such as wireless in ear or over ear personal headphones.

In this example, the earbuds 16 are IQbuds™ or IQbuds™ BOOST produced by Nuheara Limited, and as such the earbuds 16 are arranged to enhance hearing for a user and also enable the user to control the frequencies of and/or volume of ambient sounds heard by the user. The IQbuds™ and IQbuds™ BOOST are connectable to the computing device 20, for example by establishing Bluetooth pairing between the IQbuds™ or IQbuds™ BOOST and the computing device 20, and are controllable using a software application such that activation and deactivation of streaming from the smartphone 20 is controlled using the smartphone application and characteristics of the streamed audio experienced by the user are controllable using the smartphone application.

In this example, the computing device 20 used to control transmission of audio from the audio transmitter 14 to the personal audio reproducing device 16 is a portable computing device equipped with suitable communication capabilities, in this example wireless communication using Bluetooth protocols, including Bluetooth Classic and Bluetooth Low Energy (BLE) protocols, such as a smartphone, although it will be understood that any suitable computing device 20 capable of wireless communication is envisaged.

As shown in FIG. 1, in this example, the personal audio reproducing device 16 is capable of receiving wirelessly streamed audio from the audio transmitter 14 or from the smartphone 20, in this example by controlling selection of the audio stream using the smartphone 20.

Figure 2:
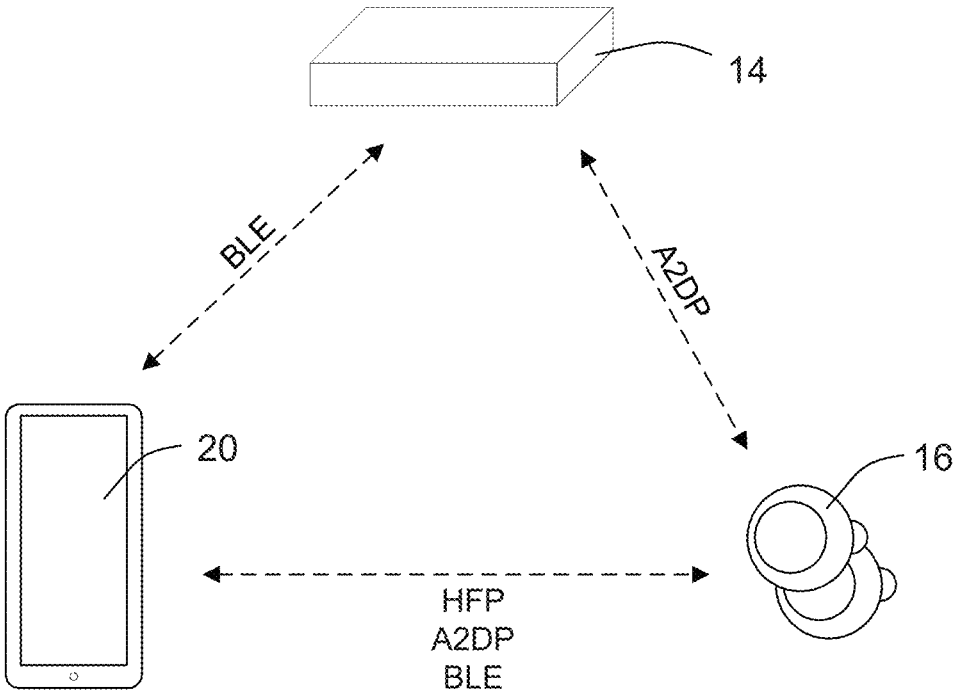
FIG. 2 is a schematic diagram illustrating connection protocols used between components of the audio reproducing system of FIG. 1.

Referring to FIG. 2, a diagram is shown illustrating connection protocols used between the audio transmitter 14, the audio reproducing device 16 and the smartphone 20.

In this example, when the smartphone 20 connects to the personal audio reproducing device 16 at least the following profiles may be used:

Hands Free Profile (HFP) that implements a connection between a HFP server at the smartphone and a HFP client at the personal audio reproducing device 16 under the Bluetooth Classic framework;

Advanced Audio Distribution Profile (A2DP) that defines parameters for Bluetooth Classic audio streaming over a Bluetooth connection in 2 channel stereo. The protocol includes a suitable codec, in this example aptX Low Latency codec that is capable of providing end-to-end latency of 32 ms; and Bluetooth Low Energy (BLE) that provides a structure for communicating commands from the smartphone 20 to the personal audio reproducing device 16.

In this example, when the smartphone 20 connects to the audio transmitter 14 the control communication framework is Bluetooth Low Energy (BLE). BLE consumes significantly less power than Bluetooth Classic, while providing a similar communication range.

In this example, when the audio transmitter 14 connects to the personal audio reproducing device 16, the A2DP profile is used to stream audio from the audio transmitter 14 to the personal audio reproducing device 16 using Bluetooth Classic audio streaming and the aptX Low Latency codec that is capable of providing end-to-end latency of 32 ms.

The system 10 also includes a group audio reproducing device 22 that generates audio publicly to the local environment. In this example, the group audio reproducing device 22 is a soundbar audio reproducing device, although it will be understood that any suitable group audio reproducing device may be used. The group audio reproducing device 22 receives third audio signals from the audio transmitter 14 that correspond to the first audio signals from the TV 12, and the group audio reproducing device 22 reproduces the audio generated by the TV so that people in the local environment can hear the audio produced by the TV without the need for a personal audio reproducing device 16.

Figure 3:
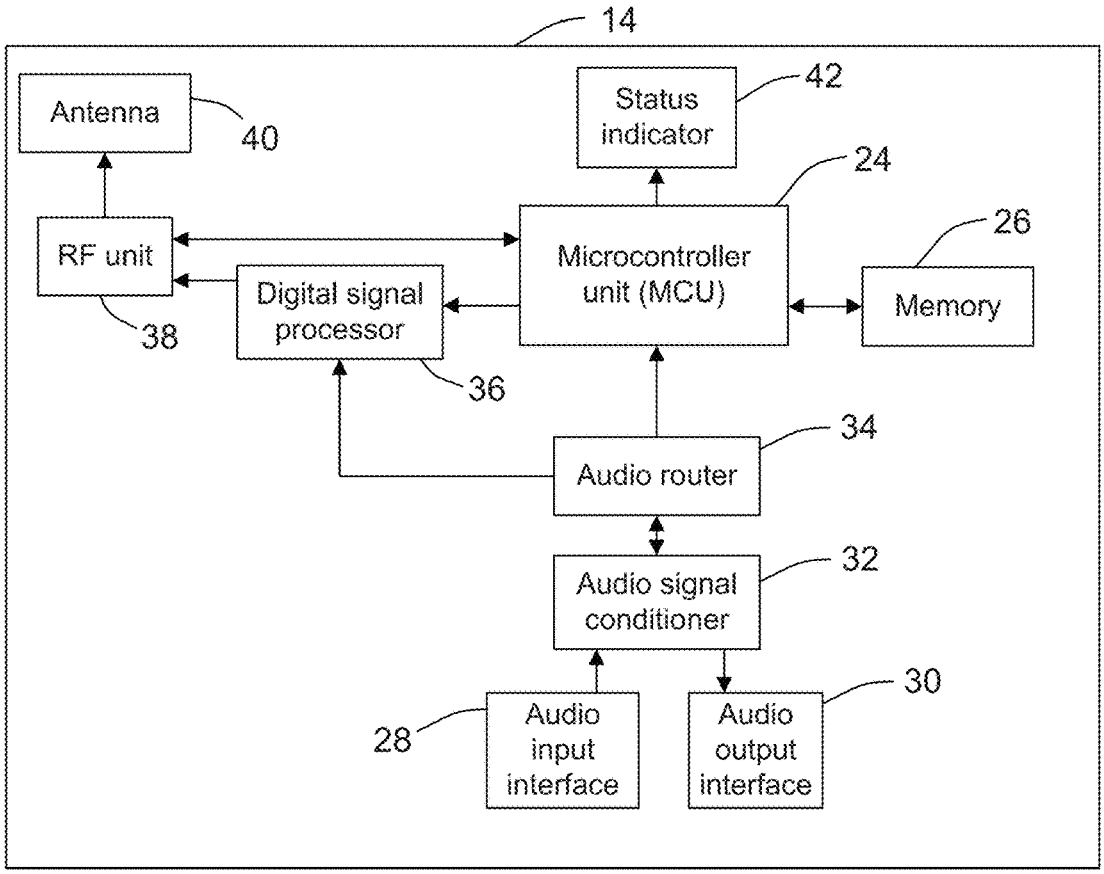
FIG. 3 is a block diagram of components of an audio transmitter according to an embodiment of the present invention.

Referring to FIG. 3, a block diagram of example components of the audio transmitter 14 is shown.

The audio transmitter 14 components include a control unit 24, in this example a microcontroller unit (MCU), arranged to control and coordinate functions in the audio transmitter 14 and implement processes that carry out desired functionality, and a memory 26 arranged to store data including code and settings information required to implement the desired functionality by the MCU 24.

The audio transmitter components also include an audio input interface 28 arranged to receive audio signals from an audio source, in this example the TV 12, and an audio output interface 30 arranged to supply audio signals representative of the input audio signals, for example to a group audio reproducing device 22 such as a soundbar. In this example, the audio input interface 28 and the audio output interface 30 include an analogue interface, such as a 3.5 mm audio jack socket, although it will be understood that other audio interfaces are envisaged, such as a digital SPDIF audio interface.

In this example, the TV 12 connects to the audio transmitter 14 using the audio input interface 28 and the audio transmitter 14 connects to the soundbar 22 using the audio output interface 30.

The audio transmitter components also include an audio signal conditioner 32 that manages audio received from the audio input interface 28 and supplied to the audio output interface 30 such that the respective audio signals are isolated from each other and from the audio signals that are used for wireless transmission to the personal audio reproducing device 16, even though the respective audio signals are representative of the same audio. Isolating the respective audio signals in this way enables sound characteristics to be individually controlled, for example so that the volume of sound produced by the personal audio reproducing device 16 can be different to and separately controllable of the audio supplied to the group audio reproducing device 22. Other individually controllable sound characteristics may include frequency equalization, frequency response, frequency dependent dynamic range, dynamic range compression and/or delay.

The audio signal conditioner 32 may also be arranged to delay the audio supplied to the audio output interface 30 so that the audio reproduced at the personal audio reproducing device 16 and the audio reproduced at the group audio reproducing device 22 are in synchronization with each other.

The audio transmitter components also include an audio router 34 that serves to direct the audio signal from the audio signal conditioner 32, and derived from the audio input interface 28, to the MCU 24 and a digital signal processor 36. The digital signal processor (DSP) 36 is arranged to encode & compress the audio signal for transmission to the personal audio reproducing device 16 over a Bluetooth Classic link, in this example using an aptX Low Latency codec. The encoded audio signal is transmitted to the personal audio reproducing device 16 using a RF unit 38 and associated antenna 40.

The audio transmitter components also include a status indicator 42 that may be used to indicate the connection status of the audio transmitter 14, to indicate whether the audio transmitter 14 is currently streaming audio, and to indicate whether the audio transmitter 14 is active, for example because an ON switch has been activated. The status indicator 42 in this example includes at least one LED.

Figure 4:
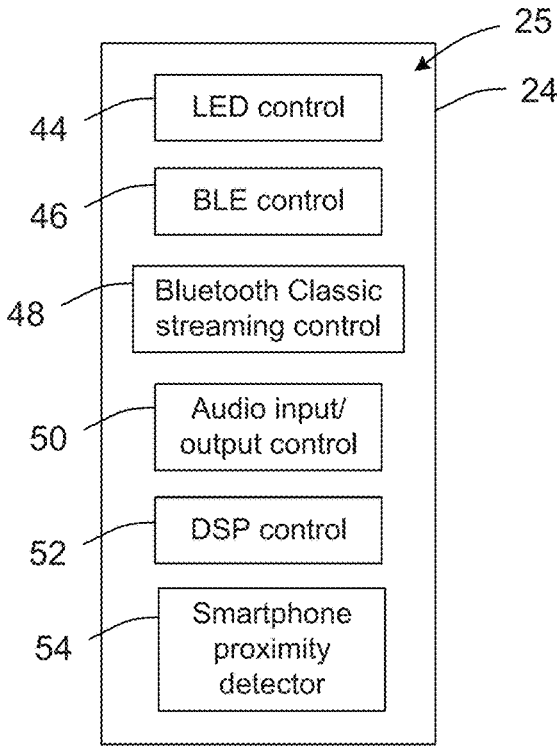
FIG. 4 is a block diagram of functional components implemented by a microcontroller of the audio transmitter shown in FIG. 3.

Referring to FIG. 4, a block diagram is shown of functional components 25 of the system 10 that in this example are implemented as processes executed by the MCU 24.

In this example, the functional components 25 include:

at least one process 44 to implement LED control, for example such that the status indicator is arranged to provide the desired visual indication according to the current connection, streaming and power activation status of the audio transmitter 14;

at least one process 46 to implement BLE control communications between a suitable application implemented on the smartphone 20 and the audio transmitter 14;

at least one process 48 to implement Bluetooth Classic streaming between the audio transmitter 14 and the personal audio reproducing device 16;

at least one process 50 arranged to respond to connection and disconnection of audio jack plugs to and from the audio input interface 28 and the audio output interface 30, for example using connection/disconnection signals from the audio router 34, so that for example the MCU 24 is aware that audio signals are being received from an external audio source 12 and can take appropriate action;

at least one process 52 arranged to effect control of the DSP 36, for example so as to cause the DSP 36 to commence or cease aptX LL encoding in response to the audio input/output control 50 determining that an audio jack plug has been connected to or disconnected from the audio input interface 28; and at least one proximity process 54 arranged to determine whether a smartphone 20 has been placed within a defined distance of the audio transmitter 14, and to instigate a connection between the smartphone and the audio transmitter 14 in response to the determination.

However, it will be understood that any other suitable processes may be implemented by the MCU 24.

Using the smartphone 20, a user is able to control streaming of audio from a desired audio transmitter 14 to the personal audio reproducing device 16, and to control parameters of the audio, including the volume of the audio experienced by a wearer of the personal audio reproducing device 16. It will be appreciated that if multiple personal audio reproducing devices 16 are receiving streamed audio from an audio transmitter 14, the volume of the audio reproduced by each personal audio reproducing device 16 may be different.

In order to use the smartphone 20 to control audio streaming, a prospective user first downloads a software application associated with the system from a suitable software repository onto the user's smartphone 20 and installs the software application on the smartphone 20.

Screens displayed to a user of the smartphone 20 during implementation of the software application are shown in FIGS. 5 to 10.

Figure 11:
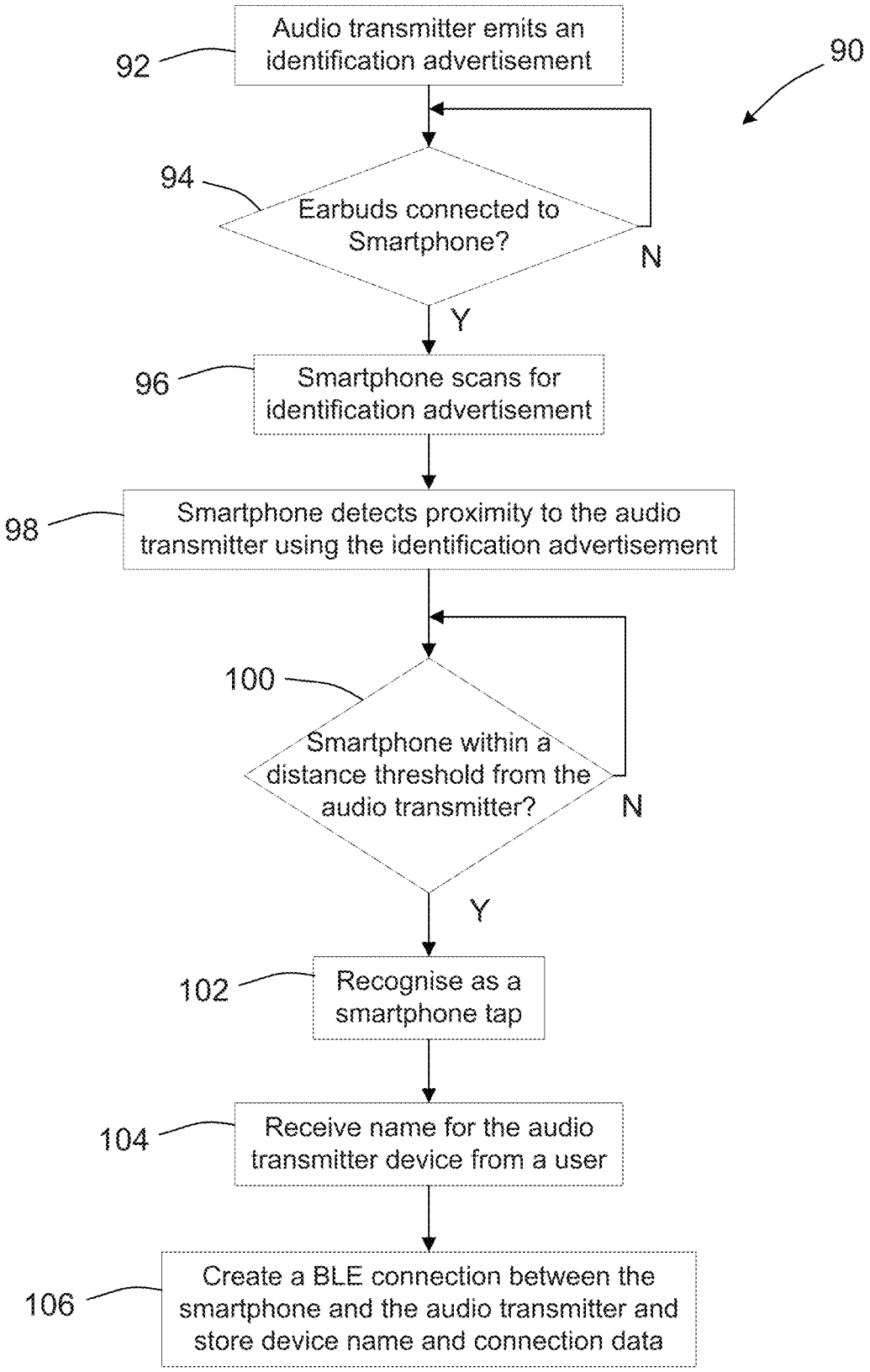
FIG. 11 is a flow diagram illustrating steps of a setup process for adding an audio transmitter to the audio reproducing system of FIG. 1.

An initial setup process for adding an audio transmitter 14 to the audio reproducing system 10 is represented in FIGS. 5 to 8, and steps 92 to 106 of the initial setup process are shown in transmitter setup flow diagram 90 in FIG. 11.

Figure 5:
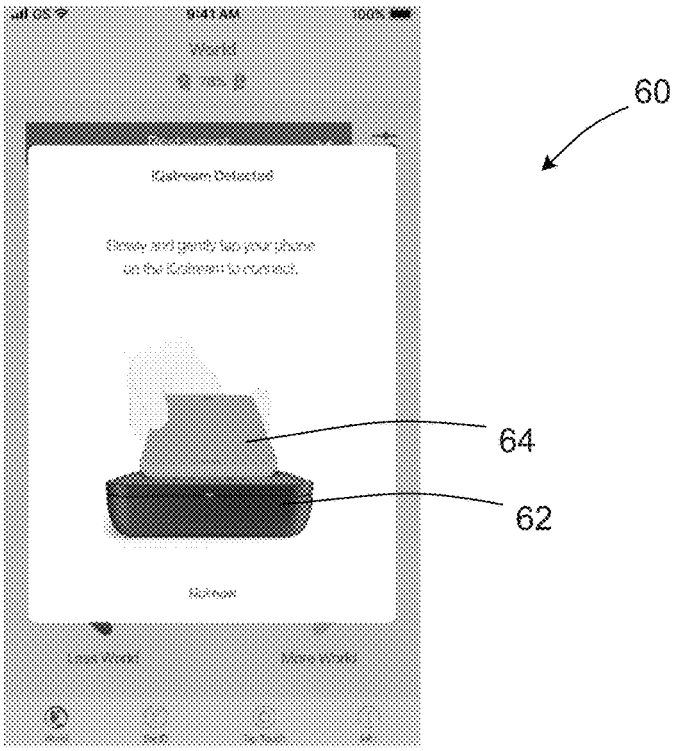
FIGS. 5 to 10 are diagrammatic representations of screens presented to a user on a smartphone of the audio reproducing system of FIG. 1.

As shown in FIG. 5, in this example when a new audio transmitter 14 is turned ON, the new audio transmitter 14 is automatically detected by the smartphone application and an audio transmitter setup screen 60 is displayed to the user. The audio transmitter setup screen 60 includes a representation 62 of an audio transmitter and a representation 64 of a smartphone 20 disposed adjacent the audio transmitter representation 62, together with an instruction to the user to bring the smartphone 20 into close proximity to the new audio transmitter 14.

Figure 6:
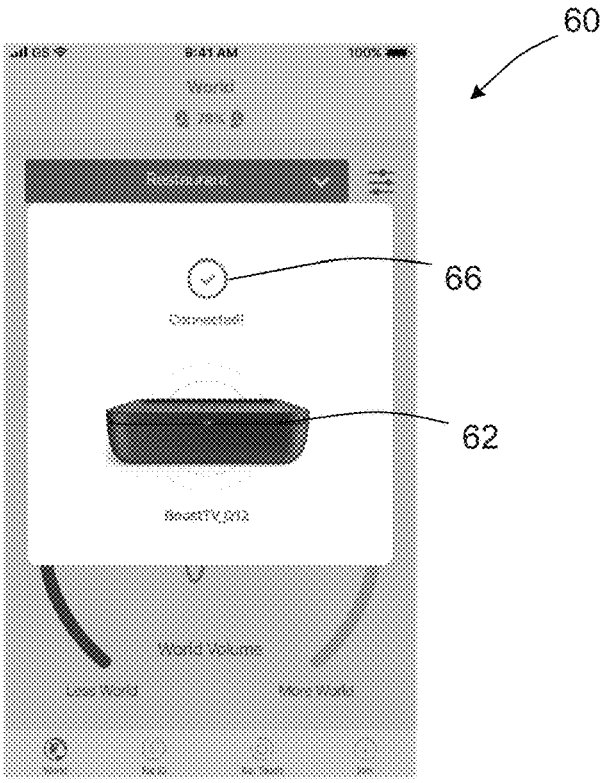

In response to bringing the smartphone 20 into close proximity to the new audio transmitter 14, a connection is established between the audio transmitter 14 and the smartphone 20, and connection confirmed indicia 66 is displayed, as shown in FIG. 6.

In this way, unintended connection to other audio transmitters 14 that may be in the vicinity of the smartphone 20 is avoided because a user is required place their smartphone near the audio transmitter 14 that is intended to be set up, thereby implicitly identifying the correct audio transmitter 14.

Figure 7:
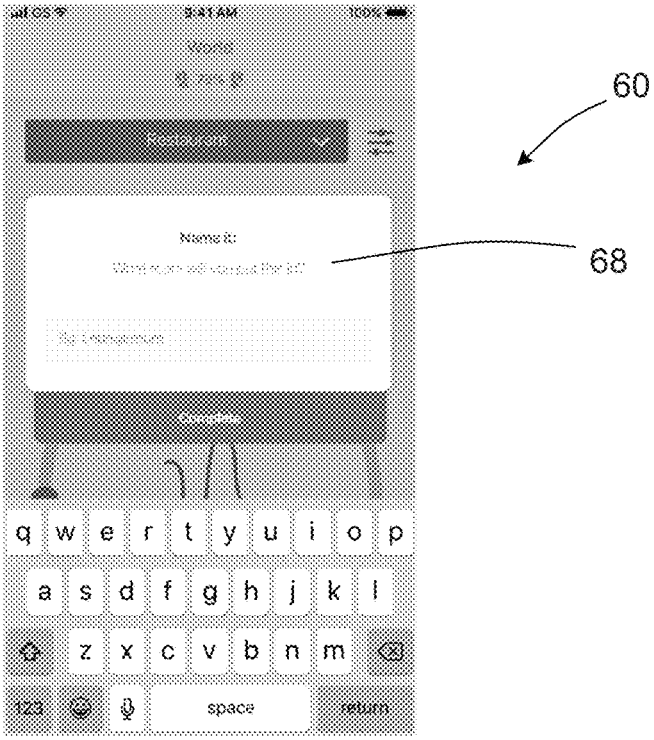
Figure 8:
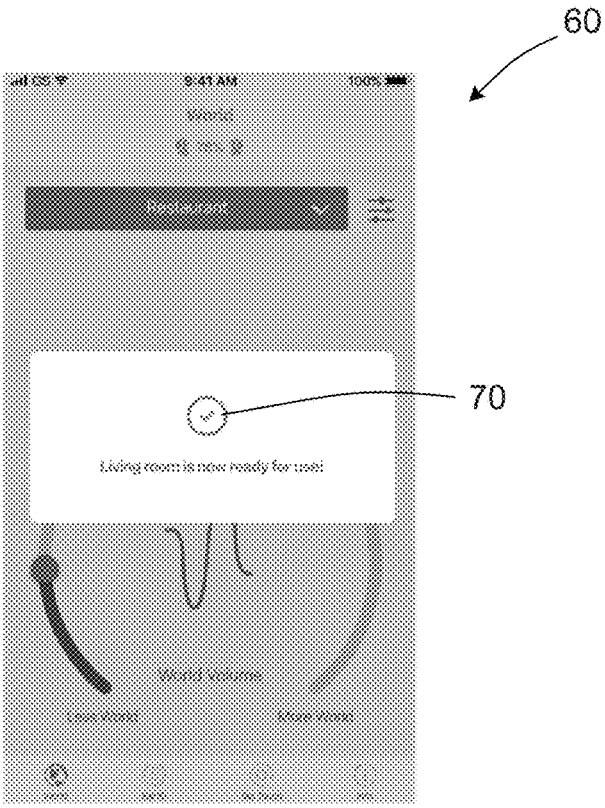

After establishment of a first connection between the audio transmitter 14 and the smartphone 20, the user is prompted to provide a name for the new audio transmitter, and in response the user adds a name to a device name field 68, as shown in FIG. 7. A setup confirmation message 70 is then displayed, as shown in FIG. 8.

Steps of the audio transmitter setup flow diagram 90 shown in FIG. 11 will now be described.

As indicated at step 92, the audio transmitter 14 is arranged to emit an identification advertisement when the audio transmitter 14 is turned ON, for example in the form of a BLE advertisement, that for example includes information indicative of a vendor identification and a product identifier unique to the audio transmitter 14. If a connection has not already been established between the smartphone 20 and the personal audio reproducing device 16, the smartphone application scans for BLE advertisements, as indicated at step 96, and uses information indicative of the proximity of the smartphone 20 to the audio transmitter 14 to determine whether the smartphone has moved within close proximity to the audio transmitter 14 to the extent that the smartphone movement can be identified as a 'tap' of the smartphone 20 on the audio transmitter 14, as indicated at steps 98 to 102.

In this example, a 'tap' is identified by generating at the smartphone 20 a received signal strength indication (RSSI) value indicative of the strength of the identification advertisement received at the smartphone 20 from the audio transmitter 14, and comparing the RSSI value with a threshold RSSI value. By defining a RSSI threshold value, a threshold proximity distance can be defined that corresponds to disposal of the smartphone 20 at a location close to the audio transmitter 14.

In order to avoid false detection of a smartphone 'tap', the smartphone application may be arranged to debounce the RSSI value, for example by tracking a differential of the RSSI value as the smartphone 20 moves closer to the audio transmitter 14.

When a smartphone 'tap' is determined to have occurred 102, the smartphone 20 application prompts the user to enter a device name for the audio transmitter, as indicated at step 104, and establishes a connection between the smartphone 20 and the audio transmitter 14, in this example a BLE connection, as indicated at step 106.

It will be understood that prior to establishing the BLE connection, the status indicator 42, in this example at least on LED, may change appearance to indicate that a connection has been established, for example by changing from a flashing light to a continuous light.

After establishment of a connection between the new audio transmitter 14 and the smartphone 20, information indicative of the new audio transmitter and any required associated connection data is stored at the smartphone for use in subsequently identifying the audio transmitter 14 and establishing a connection between the audio transmitter 14 and the smartphone 20. Such stored information in this example is associated with a Bluetooth pairing connection.

Figure 9:
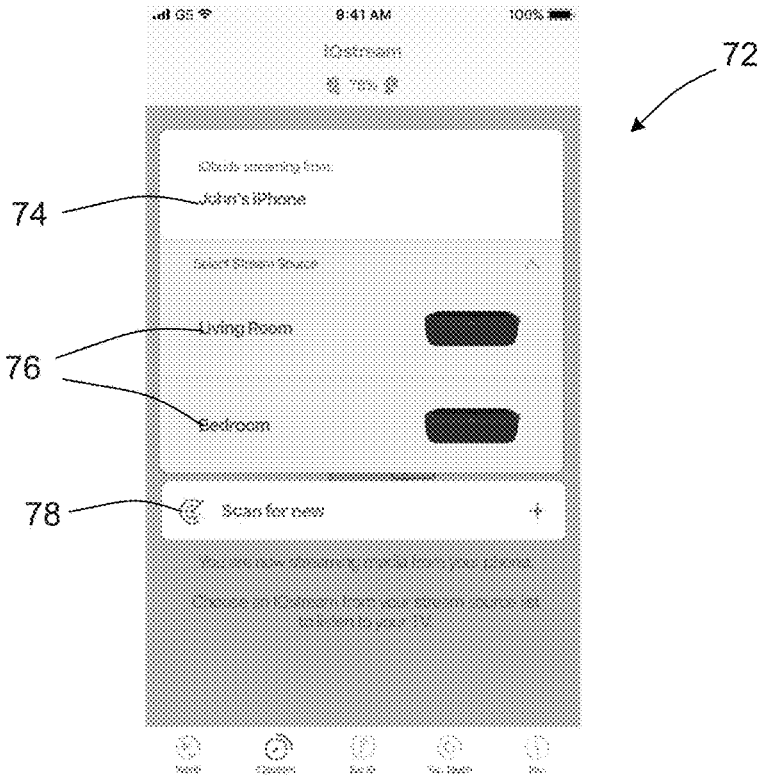
Figure 12:
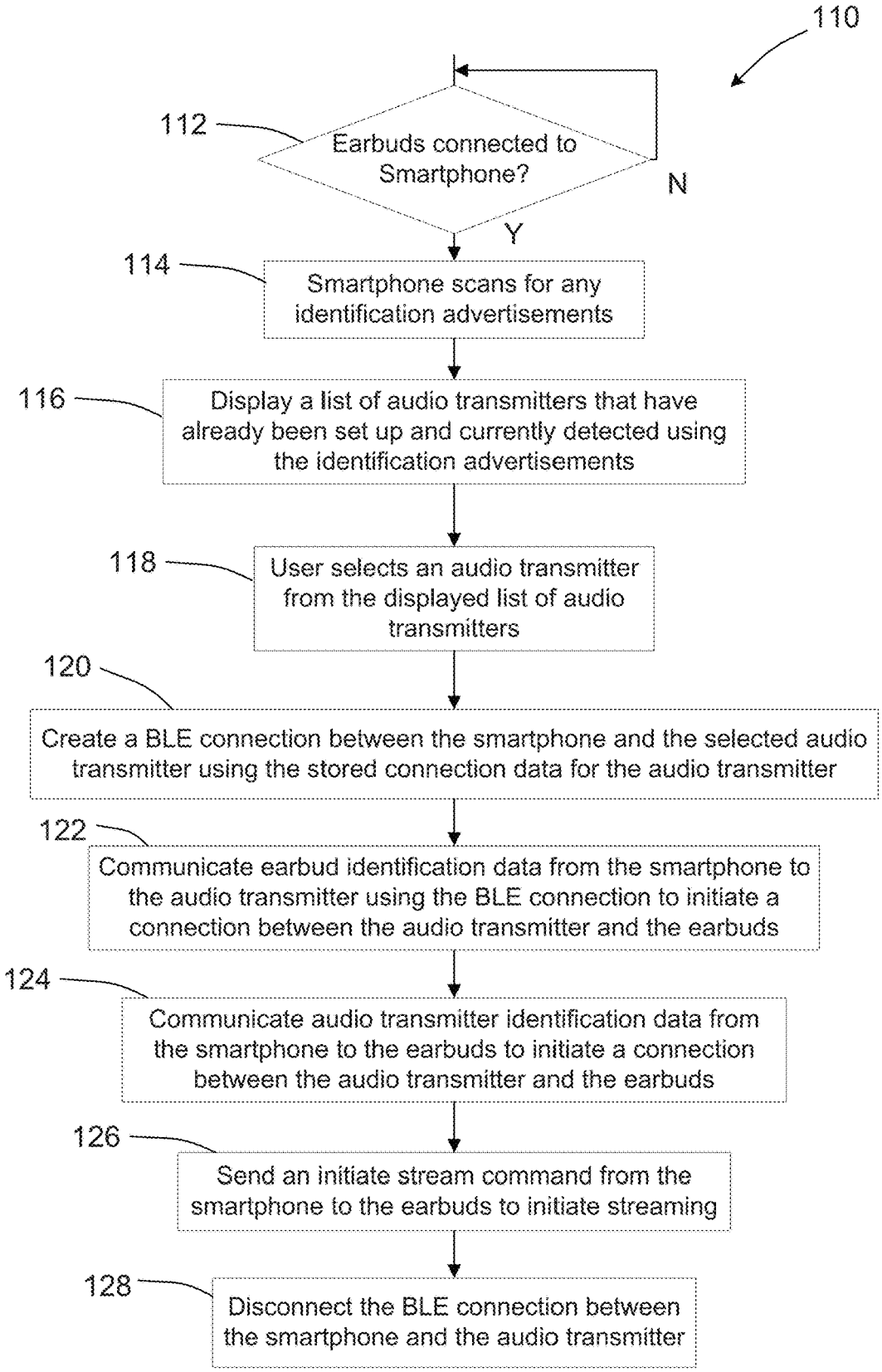
FIG. 12 is a flow diagram illustrating steps of a process for connecting a personal audio reproducing device to an audio transmitter of the audio reproducing system of FIG. 1 and streaming audio content to the personal audio reproducing device from the audio transmitter.

A process for connecting the smartphone 20 to an audio transmitter 14, and subsequently initiating streaming to a personal audio reproducing device 16, after the audio transmitter 14 has been setup according to the process shown in FIG. 11, is represented in FIG. 9, and steps 112 to 128 of the connection process are shown in the transmitter connect flow diagram 110 in FIG. 12.

As shown in FIG. 9, in this example when a user desires to stream audio from the audio transmitter 14 (from the TV 12) to a personal audio reproducing device 16, the user opens the smartphone application and operates the smartphone application to display a stream source selection screen 72. The stream source selection screen 72 shows an existing stream source indicator 74 indicative of the source of audio, if any, that is currently being used to stream audio to the personal audio reproducing device 16, and available stream source indicators 76 indicative of available audio transmitters 14 associated with available sources of audio. The list of available audio transmitters 14 includes audio transmitters 14 that are ready for use because they are:

1) In range of the smartphone 20;
2) Powered on and transmitting identification information; and
3) Have previously been associated with the smartphone 20 through the 'tap' setup process described above.

Selection of a desired available stream source indicator 76 causes the smartphone application to establish a BLE connection between the selected audio transmitter 14 and the smartphone 20 using the stored audio transmitter identification information and associated connection data.

The stream source selection screen 72 also includes a scan button 78 that enables a user to initiate a scan for any new audio transmitters 14. Selection of the scan button 78 causes the audio transmitter setup process similar to the process shown in FIG. 11 to be implemented if a new audio transmitter 14 is detected.

Steps of the audio transmitter connection flow diagram 100 shown in FIG. 12 will now be described.

As discussed in relation to the transmitter setup flow diagram 90 in FIG. 11, the audio transmitter 14 is arranged to emit an identification advertisement, in this example in the form of a BLE advertisement, that enables the presence and identity of the audio transmitter 14 to be determined by the smartphone 20. If a connection has previously been established between the smartphone 20 and the personal audio reproducing device 16 such that, in this example, a Bluetooth pairing connection already exists, the smartphone application scans for BLE advertisements, as indicated at step 114, and displays a list of audio transmitters 14 that have already been set up and are available to select as a streaming source, as indicated at step 116. Using the displayed list, the user then selects an audio transmitter corresponding to the desired audio source, as indicated at step 118, and in response a BLE connection is established between the selected audio transmitter 14 and the smartphone 20 using the stored audio transmitter identification information and associated connection data, as indicated at step 120.

In order to initiate audio streaming, identification data indicative of the personal audio reproducing device 16 connected to the smartphone 20 is communicated from the smartphone 20 to the audio transmitter 14, and identification data indicative of the selected audio transmitter 14 is communicated from the smartphone 20 to the connected personal audio reproducing device 16, which causes a streaming connection to be established between the selected audio transmitter 14 and the personal audio reproducing device 16, as indicated at steps 122 and 124.

If the smartphone 20 is able to successfully connect to the personal audio reproducing device 16 and the smartphone 20 is able to successfully connect to the selected audio transmitter 14, but the connection between the selected audio transmitter 14 and the personal audio reproducing device 16 is unsuccessful, the smartphone 20 will attempt several times to initiate audio streaming until a successful connection between the selected audio transmitter 14 and the personal audio reproducing device 16 is established. If after several attempts, a connection between the selected audio transmitter 14 and the personal audio reproducing device 16 cannot be established, a user notification to this effect may be displayed to the user.

After establishing a streaming connection between the selected audio transmitter 14 and the personal audio reproducing device 16, the smartphone sends an initiate streaming command from the smartphone 20 to the personal audio reproducing device 16 that causes streaming from the audio transmitter 14 to the personal audio reproducing device 16 to commence, as indicated at step 126.

After commencement of audio streaming, the BLE connection between the smartphone 20 and the audio transmitter 14 ceases, as indicated at step 128.

Figure 10:
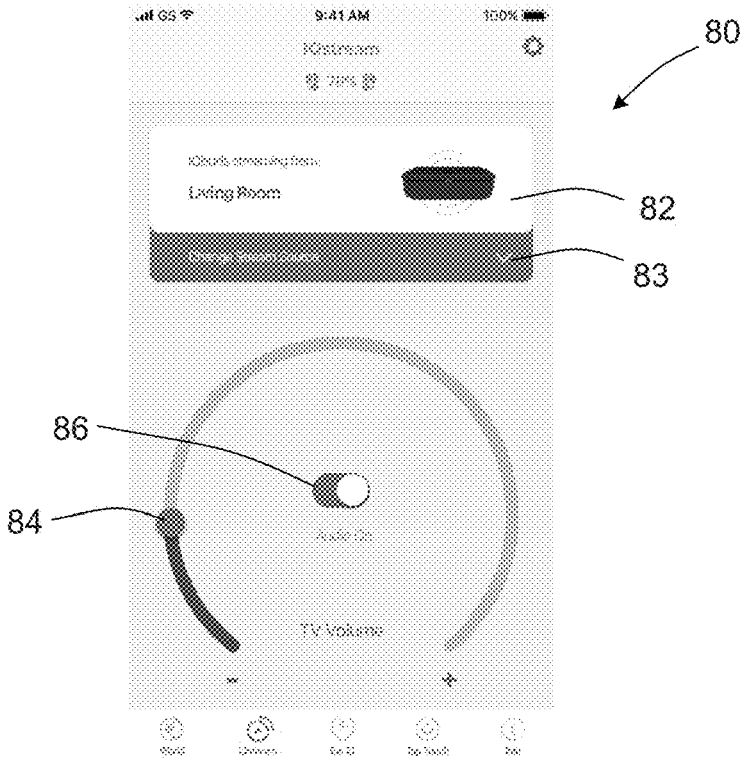

As shown in FIG. 10, a streaming control screen 80 may be used during streaming by a user to select a different streaming source or to change the volume of the sound reproduced by the personal audio reproducing device 16.

The streaming control screen 80 includes an existing stream identifier 82 that indicates the current streaming source, a change stream source drop-down box 83 usable to select a different streaming source, a volume control slider 84 usable to change the volume of the sound reproduced by the personal audio reproducing device 16, and an audio mute button 86 usable to mute the sound reproduced by the personal audio reproducing device 16, in this example by sending a command over BLE to stop the audio stream to give the impression of muting the audio. Changing the volume using the volume control slider 84 causes a command signal, in this example a volume control command over BLE, to be communicated from the smartphone 20 to the personal audio reproducing device 16.

It will be understood therefore that using the smartphone application, a user is able to select a streaming source, and subsequently control the volume of the streamed audio experienced by the user.

It will be understood that irrespective of the connection status and/or streaming status of the audio transmitter 14, audio from the TV 12 is nevertheless supplied to and reproduced by the group audio reproducing device 22.

Figure 13:
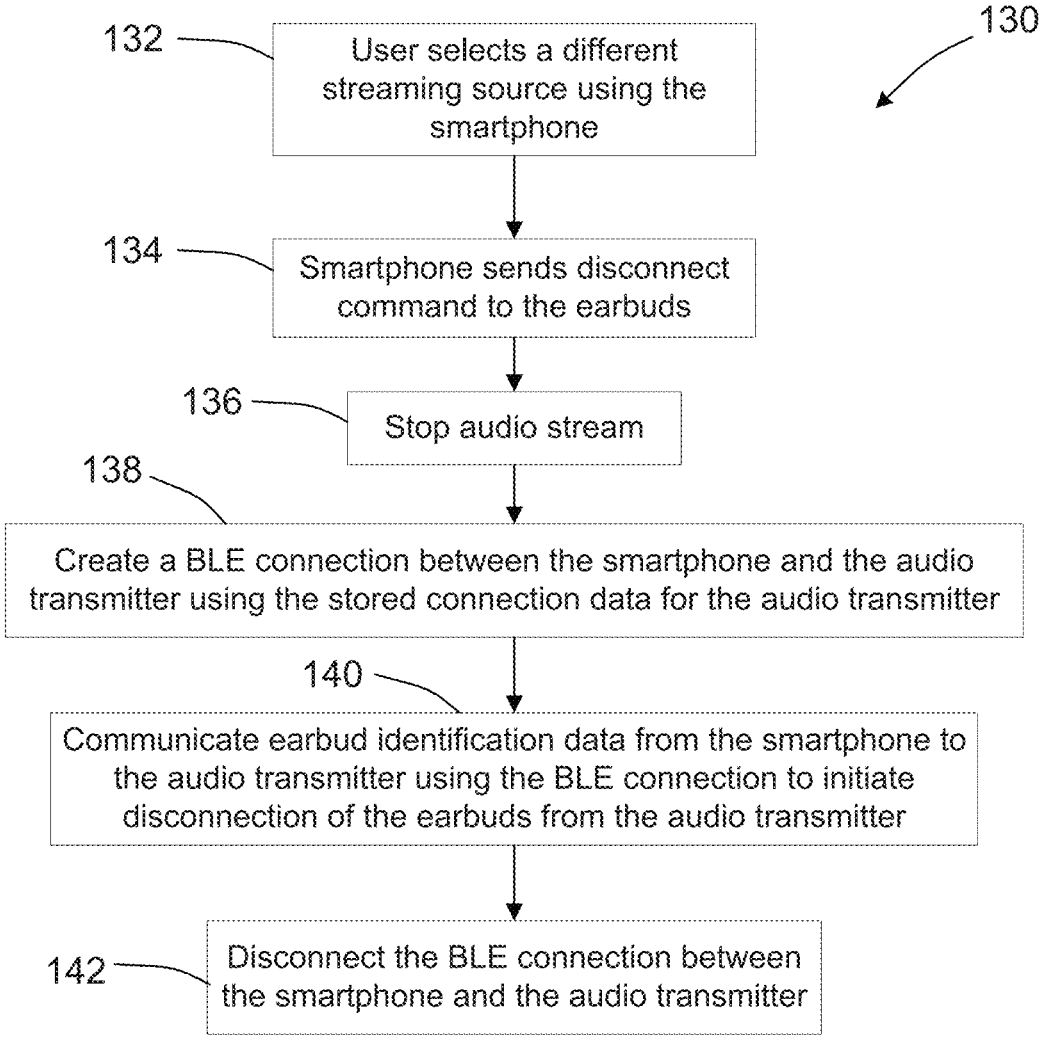
FIG. 13 is a flow diagram illustrating a process for disconnecting a personal audio reproducing device from an audio transmitter of the audio reproducing system of FIG. 1 when the disconnection is instigated by a smartphone of the audio reproducing system.

A flow diagram 130 illustrating steps 132 to 142 of a process for disconnecting a personal audio reproducing device 16 from an audio transmitter 14 when disconnection is instigated by the smartphone 20 is shown in FIG. 13.

If a user selects a different audio transmitter 14 using the smartphone application, as indicated at step 132, the smartphone 20 sends a disconnect command to the personal audio reproducing device 16, in this example using BLE, as indicated at step 134, that causes a disconnection process to initiate at the personal audio reproducing device 16. This causes the audio stream to cease, as indicated at step 136.

The smartphone then initiates a BLE connection with the existing audio transmitter 14 using the stored audio transmitter identification information and associated connection data, as indicated at step 138, and the smartphone communicates disconnection information including information indicative of the personal audio reproducing device 16 to the audio transmitter 14 using the BLE connection to enable the audio transmitter 14 to initiate a disconnection process at the audio transmitter 14, as indicated at step 140. The smartphone 20 then ceases the BLE connection between the smartphone and the audio transmitter 14, as indicated at step 142.

Figure 14:
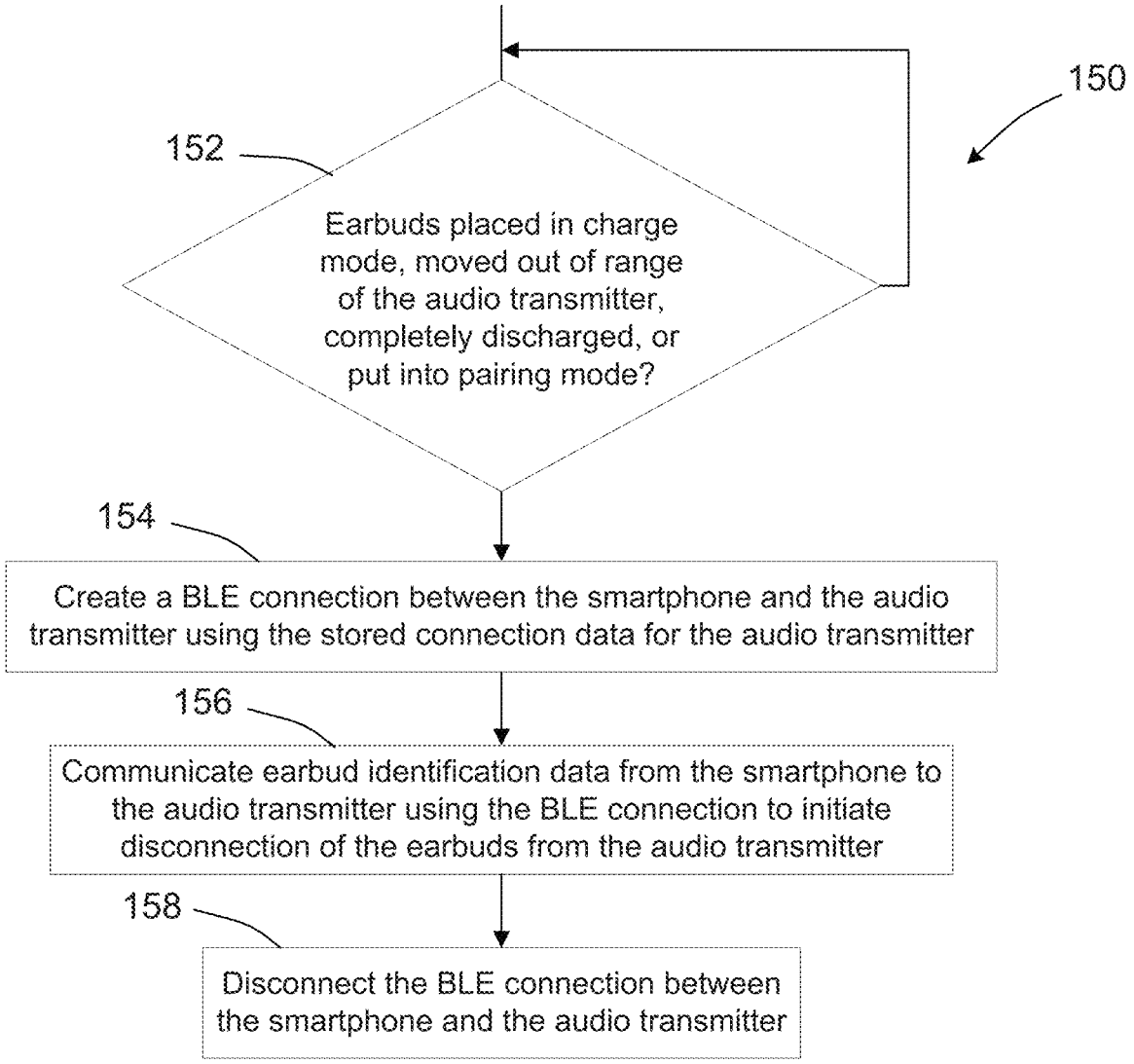
FIG. 14 is a flow diagram illustrating a process for disconnecting a personal audio reproducing device from an audio transmitter of the audio reproducing system of FIG. 1 when the disconnection is instigated by the personal audio reproducing device of the audio reproducing system.

A flow diagram 150 illustrating steps 152 to 158 of a process for disconnecting a personal audio reproducing device 16 from an audio transmitter 14 when disconnection is instigated by the personal audio reproducing device 16 is shown in FIG. 14.

As indicated at step 152, in this example disconnection may be instigated by the personal audio reproducing device 16 because the personal audio reproducing device 16 has been paced in charge mode, has been moved out of range of the audio transmitter 14, has completely discharged or has been placed in Bluetooth pairing mode.

The smartphone then initiates a BLE connection with the audio transmitter 14 using the stored audio transmitter identification information and associated connection data, as indicated at step 154, and the smartphone communicates information indicative of the personal audio reproducing device 16 to the audio transmitter 14 using the BLE connection to enable the audio transmitter 14 to initiate a disconnection process at the audio transmitter 14, as indicated at step 156. The smartphone 20 then ceases the BLE connection between the smartphone and the audio transmitter 14, as indicated at step 158.

It will be appreciated that the present audio reproducing system 10 enables a user that for example may have hearing difficulties to receive audio from a source such as a TV at a volume that is appropriate for the user whilst other users in the same vicinity can also hear audio from the TV at a volume that is appropriate for them.

It will also be understood that the system provides a simple, seamless, user friendly experience to a user in that an initial connection to an audio transmitter 14 is established with a simple tap of the user's smartphone 20 on the audio transmitter 14, and subsequent connection to an audio transmitter and control of audio is carried out by providing simple commands using one smartphone application.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Modifications and variations as would be apparent to a skilled addressee are determined to be within the scope of the present invention.

The invention claimed is:

1. An audio transmitter comprising:

an audio input interface arranged to receive first audio signals indicative of input audio from an audio source;

a wireless transmitter arranged to wirelessly stream second audio signals indicative of the input audio to a personal first audio reproducing device wearable by a user; and an audio output interface connectable to a second audio reproducing device, the audio transmitter arranged to supply third audio signals indicative of the input audio to the audio output interface;

the audio transmitter arranged to facilitate connection by a computing device to the audio transmitter to facilitate control of wireless streaming of the second audio signals using the computing device;

wherein at least one characteristic of sound associated with the wirelessly streamed second audio signals is controllable independently of at least one characteristic of sound associated with the third audio signals; and wherein an initial connection is established between the audio transmitter and the computing device in response to detection that a location of the computing device relative to the audio transmitter is less than a defined threshold.

2. The audio transmitter as claimed in claim 1, wherein the audio input interface is a wired audio input interface.

3. The audio transmitter as claimed in claim 1, wherein the audio output interface is a wired audio output interface.

4. The audio transmitter as claimed in claim 1, wherein the audio transmitter is arranged to wirelessly stream the second audio signals using a Bluetooth connection.

5. The audio transmitter as claimed in claim 4, wherein the Bluetooth connection uses Bluetooth Classic protocols.

6. The audio transmitter as claimed in claim 4, wherein the audio transmitter includes a digital signal processor arranged to encode the second audio signals using a low latency protocol.

7. The audio transmitter as claimed in claim 1, wherein the audio transmitter is arranged to communicate with the computing device using a Bluetooth connection.

8. The audio transmitter as claimed in claim 7, wherein the Bluetooth connection uses a Bluetooth Low Energy protocol.

9. The audio transmitter as claimed in claim 1, wherein the audio transmitter comprises an audio signal conditioner arranged to modify a timing of the third audio signals relative to the second audio signals so that audio from the personal first audio reproducing device and the second audio reproducing device connected to the audio output interface are in synchronization with each other at the user.

10. The audio transmitter as claimed in claim 1, wherein the audio transmitter is arranged to emit an identification advertisement including unique identification information associated with the audio transmitter, the unique identification information usable by the computing device to identify the audio transmitter.

11. The audio transmitter as claimed in claim 1, wherein the audio transmitter comprises a status indicator arranged to visually indicate a connection status, streaming status and/or power status of the audio transmitter.

12. The audio transmitter as claimed in claim 1, wherein the at least one characteristic of sound includes sound volume, equalization, frequency response, phase, frequency dependent dynamic range, dynamic range compression, noise and/or delay.

13. The audio transmitter as claimed in claim 1, wherein the audio transmitter is arranged to facilitate connection by the computing device to the audio transmitter to facilitate activation of wireless streaming of the second audio signals using the computing device and/or control of at least one characteristic of sound associated with the wirelessly streamed second audio signals.

14. An audio reproducing system comprising:

an audio transmitter comprising:

an audio input interface arranged to receive first audio signals indicative of input audio from an audio source;

a wireless transmitter arranged to wirelessly stream second audio signals indicative of the input audio to a personal first audio reproducing device wearable by a user; and an audio output interface connectable to a second audio reproducing device, the audio transmitter arranged to supply third audio signals indicative of the input audio to the audio output interface;

a computing device wirelessly connectable to the audio transmitter and usable to control wireless streaming of the second audio signals and to control a sound volume associated with the wirelessly streamed second audio signals;

the audio transmitter arranged to facilitate connection by the computing device to the audio transmitter to facilitate control of wireless streaming of the second audio signals using the computing device;

wherein at least one characteristic of sound associated with the wirelessly streamed second audio signals is controllable independently of at least one characteristic of sound associated with the third audio signals; and wherein an initial connection is established between the audio transmitter and the computing device in response to detection that a location of the computing device relative to the audio transmitter is less than a defined threshold; and wherein the audio reproducing system is arranged to determine whether the computing device has moved to the location within the defined threshold from the audio transmitter, and to create and store connection information associated with a wireless connection between the computing device and the audio transmitter when the location of the computing device is less than the defined threshold.

15. The audio reproducing system as claimed in claim 14, wherein the computing device is arranged to determine a signal strength value indicative of a signal strength of an identification advertisement received at the computing device, and to determine whether the computing device has moved to the location within the defined threshold from the audio transmitter by comparing the signal strength value with a reference threshold value.

16. The audio reproducing system as claimed in claim 15, wherein the signal strength value comprises a received signal strength indication (RSSI) value.

17. The audio reproducing system as claimed in claim 15, wherein the computing device is arranged to debounce the signal strength value.

18. The audio reproducing system as claimed in claim 17, wherein the computing device is arranged to debounce the signal strength value by tracking a differential of the signal strength value as the computing device moves closer to the audio transmitter.

19. The audio reproducing system as claimed in claim 14, wherein the computing device is arranged to receive an identification advertisement and to display audio transmitter indicia indicative of the audio transmitter, the displayed audio transmitter indicia being selectable by the user to instigate wireless streaming of the second audio signals to the personal first sound reproducing device.

20. The audio reproducing system as claimed in claim 19, wherein the computing device is arranged to receive identification advertisements associated with multiple different audio transmitters, and to display audio transmitter indicia indicative of the audio transmitters for selection by the user.

21. The audio reproducing system as claimed in claim 19, wherein the computing device is arranged to wirelessly connect to the personal first sound reproducing device, and the system is arranged to instigate streaming of the second audio signals to the personal first sound reproducing device connected to the computing device when the audio transmitter is selected by the user using the computing device.

22. The audio reproducing system as claimed in claim 19, wherein when the audio transmitter is selected by the user using the computing device, the computing device is arranged to:

communicate personal audio reproducing device identification data indicative of the personal first audio reproducing device connected to the computing device to the audio transmitter, and communicate audio transmitter identification data indicative of the selected audio transmitter to the personal first audio reproducing device connected to the computing device;

wherein the communicated personal audio reproducing device identification data and audio transmitter identification data are used to initiate a streaming connection between the audio transmitter and the personal first audio reproducing device.

23. The audio reproducing system as claimed in claim 14, wherein the computing device is arranged to communicate with the personal first audio reproducing device using a Bluetooth connection.

24. The audio reproducing system as claimed in claim 23, wherein the Bluetooth connection uses a Bluetooth Classic protocol and a BLE protocol.

25. The audio reproducing system as claimed in claim 14, wherein the system is arranged such that the computing device connects to the audio transmitter only when control signals are communicated between the computing device and the audio transmitter.

26. The audio reproducing system as claimed in claim 14, wherein the computing device comprises a smartphone.

27. The audio reproducing system as claimed in claim 14, wherein the system comprises the personal first audio reproducing device comprises a pair of earbuds, or wireless in ear or over ear headphones.

28. The audio reproducing system as claimed in claim 14, wherein the computing device is arranged to send a volume control signal to the personal first audio reproducing device in response to volume control input from the user, the personal first audio reproducing device using the volume control signal to modify the volume of sound associated with the wirelessly streamed second audio signals.

* * * * *